United States Patent [19]

Bell

[11] 4,338,686

[45] Jul. 13, 1982

[54] GARMENT WITH ABSORBENT PAD

[76] Inventor: Michael Bell, P. O. Box 400, Warrington, Pa. 18976

[21] Appl. No.: 194,496

[22] Filed: Oct. 6, 1980

Related U.S. Application Data

[63] Continuation-in-part of Ser. No. 83,726, Oct. 10, 1979, abandoned.

[51] Int. Cl.[3] ..... A41D 1/02

[52] U.S. Cl. ..... 2/93; 2/2; 2/97; 2/DIG. 2

[58] Field of Search ..... 2/97, 74, 87, 88, 2, 2/93, DIG. 2

[56] References Cited

U.S. PATENT DOCUMENTS

| | | | |
|---|---|---|---|
| 2,264,503 | 12/1941 | Berin | 2/74 |
| 2,617,106 | 11/1952 | Pritzker | 2/97 |
| 2,627,072 | 2/1953 | Frommett et al. | 2/97 X |
| 2,630,573 | 3/1953 | Rand | 2/97 |
| 2,976,539 | 3/1961 | Brown, Jr. | 2/97 X |
| 2,990,550 | 7/1961 | Locketz | 2/97 |
| 3,034,133 | 5/1962 | Eilenberg | 2/97 |
| 3,514,788 | 6/1970 | Miller | 2/87 |
| 3,911,498 | 10/1975 | Van Staagen | 2/74 |

FOREIGN PATENT DOCUMENTS

| | | | |
|---|---|---|---|
| 18887 | of 1898 | United Kingdom | 2/97 |

*Primary Examiner*—H. Hampton Hunter

*Attorney, Agent, or Firm*—Caesar, Rivise, Bernstein & Cohen, Ltd.

[57] ABSTRACT

A covering adapted to be worn on the body of a person and formed of a fabric having an inner and an outer surface. Each of the surfaces includes a moisture barrier thereon. Each moisture barrier includes a multitude of small openings therein exposing the moisture absorbent material to the air trapped between the covering and the body of the person. One of the barriers is metallized to reflect radiant-energy and the other barrier is darkly colored to absorb radiant-energy. In one embodiment, the covering is arranged to be releasably secured within a conventional garment to absorb moisture trapped therein. In another embodiment, the covering forms a garment itself.

11 Claims, 8 Drawing Figures

FIG. 5
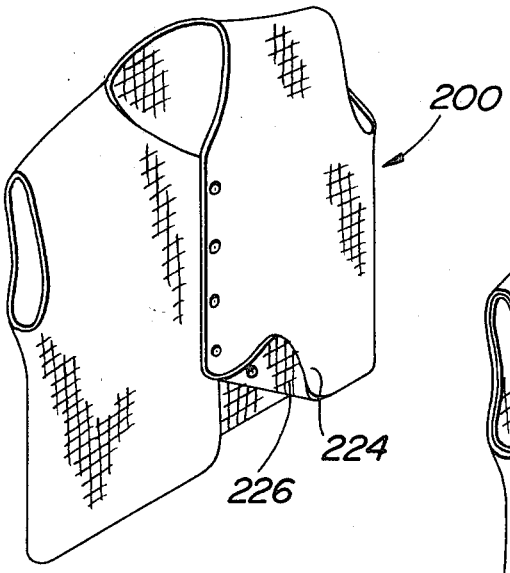
FIG. 6
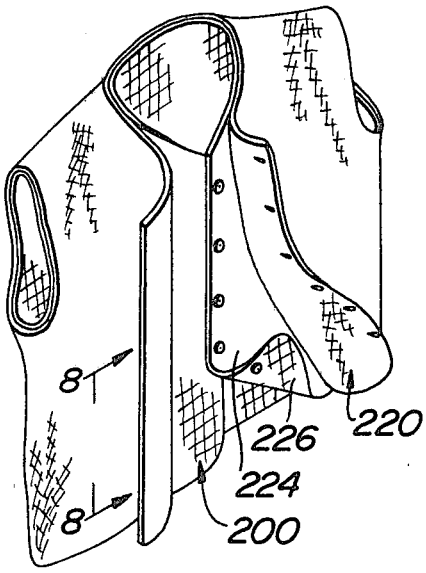
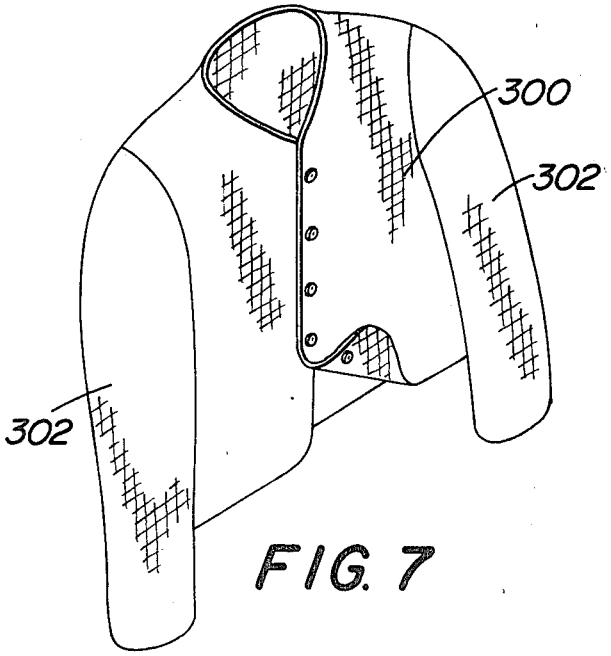
FIG. 7
FIG. 8
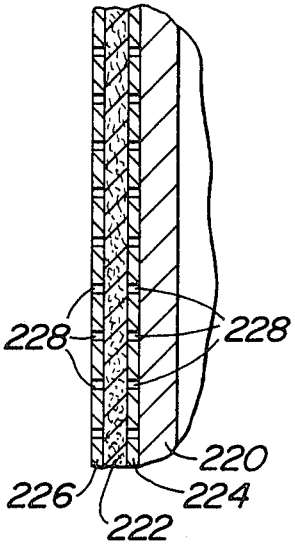

GARMENT WITH ABSORBENT PAD

This invention relates generally to covering for the body and more particularly to covering including means for absorbing moisture laden air trapped between the covering and the body and is a continuation-in-part of my co-pending U.S. application Ser. No. 83,726 filed on Oct. 10, 1979, now abandoned, and whose disclosure is incorporated by reference herein.

Garments arranged to be worn on the upper torso of persons and formed of impervious material, such as nylon, rubber, vinyl, etc. commonly exhibit the tendency to trap moisture laden air within the garment. This characteristic is particularly true when the wearer is physically active so as to perspire heavily. In the event that the temperature of the ambient air is relatively cool, the moisture laden air condenses on the inner surface of the garment at the top thereof, making the wearer quite uncomfortable.

Commercially available rainsuits and athletic wear, e.g., jogging suits or jackets, have made use of vents within the jacket portion to allow the moisture laden air to escape. However, such construction has not proved sufficiently effective.

In U.S. Pat. No. 3,911,498 there is disclosed a sports garment, i.e., tennis dress, having a moisture absorbent lining located adjacent the neck and arm openings of the garment. The lining is releasably secured to the back of the garment adjacent the neck and arm openings. The lining is formed of a material which acts as a wick to absorb perspiration via direct contact with the wearer's skin. While the garment of U.S. Pat. No. 3,911,498 appears viable for the absorption of perspiration from the wearer's skin, its construction does not render it suitable for applications involving the absorbing moisture laden air trapped within impervious garments.

Accordingly, it is the general object of the instant invention to provide a covering to be worn on the body and formed of material for absorbing moisture laden air trapped between said covering and said body.

It is another object of the instant invention to provide a garment to be worn on the body for absorbing moisture laden air trapped between the garment and said body.

It is a further object of the instant invention to provide for use in a garment formed of a relatively impervious material, moisture absorbing means for absorbing moisture laden air trapped within said garment.

It is a further object of the instant invention to provide for use in a garment formed of a relatively impervious material, a moisture absorbing pad which is relatively simple in construction and inexpensive and can be releasably secured within said garment so that it can be discarded after use.

It is a further object of the instant invention to provide for use in a garment formed of a relatively impervious material, a moisture absorbent pad having means for reflecting radiant energy from the wearer of said garment.

It is still a further object of the instant invention to provide for use in a garment formed of a relatively air-impervious material a moisture absorbent pad having means for absorbing radiant energy.

These and other objects of the instant invention are achieved by providing a covering adapted to be worn on the body of a person and formed of a fabric having an inner and an outer surface. Each of the surfaces includes a moisture barrier thereon. Each moisture barrier includes plural openings therein exposing the moisture absorbent material to the air trapped between the covering and the body of the person.

In one embodiment, the covering is arranged to be located within a garment to absorb moisture trapped therein. In another embodiment, the covering forms the garment itself.

Other objects and many of the attendant advantages of the instant invention will be readily appreciated as the same becomes better understood by reference to the following detailed description when considered in connection with the accompanying drawing wherein:

FIG. 5 is a perspective view of a reversible vest constructed in accordance with a second aspect of this invention;

FIG. 6 is a perspective view of the vest shown in FIG. 5 disposed within a conventional vest;

FIG. 7 is an enlarged sectional view taken along line 7—7 of FIG. 6; and FIG. 8 is a perspective view of a reversible jacket constructed in accordance with said second aspect of this invention.

Figure 1:
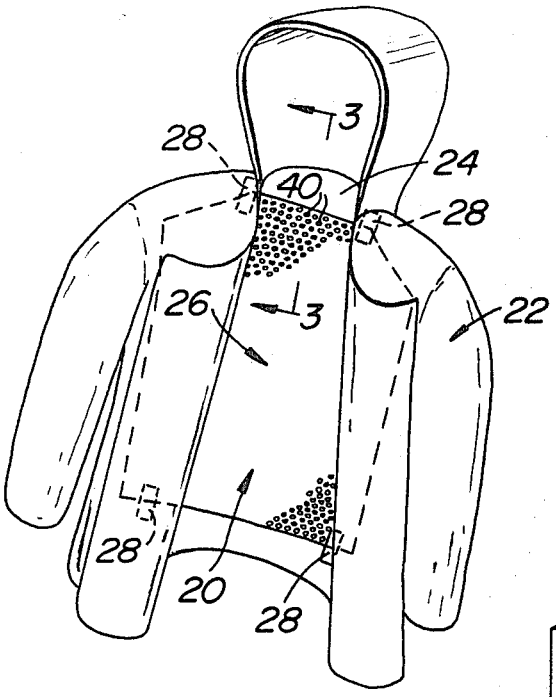
FIG. 1 is a perspective view of a conventional garment including one embodiment of a covering in accordance with one aspect of the instant invention.

Referring now in greater detail to the various figures of the drawing wherein like reference characters refer to like parts, there is shown in FIG. 1 a moisture absorbing covering or attachment 20 of the instant invention mounted within a garment 22.

The garment 22 is of conventional construction and can take many shapes, e.g., a hooded jacekt, a non-hooded jacket, a parka, a cape, a poncho, etc. Such garments are commonly formed of an air and/or water-impervious material, e.g., rubber, vinyl, nylon, etc., so as to provide sufficient protection from inclement or cold weather.

The covering 20 of the instant invention is arranged to be releasably secured on the interior surface 24 of the back of the garment adjacent the shoulder area for absorbing the moisture in moisture laden air trapped within the garment.

The covering is preferably located on the garment's back adjacent the shoulder area since the upper portion of the garment is where most of the moist, warm air is trapped. However, this invention contemplates the location of the covering 20 at various other positions, depending upon garment construction or other factors. By absorbing moisture in the air trapped within the garment, the covering 20 reduces fatigue caused by heat stress while also keeping the wearer dry and comfortable even when undergoing physical exertion in cool or wet weather conditions.

Figure 2:
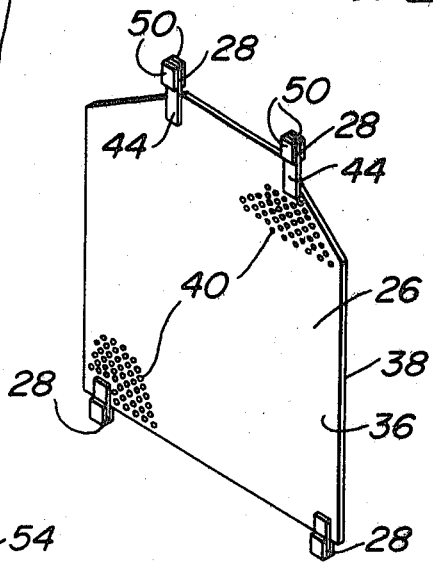
FIG. 2 is a perspective view of the embodiment of the covering shown in FIG. 1.
Figure 3:
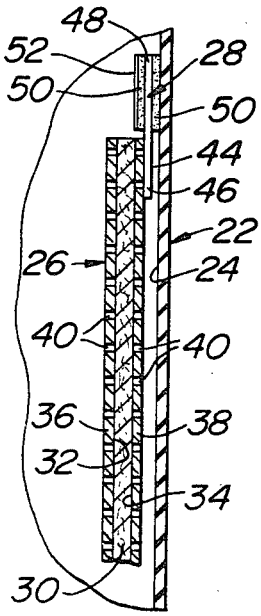
FIG. 3 is an enlarged sectional view taken along line 3—3 of FIG. 1.

Referring now to FIGS. 2 and 3, the details of the construction of the covering 20 will be discussed. As can be seen therein, the covering 20 basically comprises moisture absorbing means 26 in the form of a pad and releasable securement means 28 for mounting the pad 26 within the garment on the inner surface 24 thereof.

The pad 26 comprises a moisture absorbing central layer 30 having an inner surface 32 and an outer surface 34. The central layer 30 can be formed of any moisture absorbent, natural or synthetic material and can be a woven, non-woven, or knitted fabric. In the interest of cost reduction, a non-woven fabric made from natural or synthetic fibers, polyethylene specially treated for moisture absorbency is a preferable material or fabric. The fabric forming the central layer includes a moisture barrier 36 on its inner surface and a moisture 38 on its outer surface. The moisture barriers are impervious to water and can be formed of any suitable material. In order for the absorptive layer 30 to absorb material in the moisture laden air trapped within the garment each of the moisture barriers 36 and 38 includes a large plurality of multitude of openings or perforations 40 therein. The perforations extend fully through the barrier layers 36 and 38 to expose portions of the moisture absorbent fabric 30 disposed therebetween. One particularly suitable material for forming the perforated moisture barriers comprises perforated polyolefin film, such as polypropylene or polyethylene, like that sold under the trademark DELNET P520 by Hercules, Inc. of Wilmington, DE, and which is laminated to the both sides of the central layer 30.

As mentioned heretofore, the pad 26 is arranged to be releasably secured onto the inner surface 24 of the garment. To that end, releasable securement means 28 is provided. In the embodiment of the invention shown in FIGS. 2 and 3, the releasable securement means 28 comprises a plurality of strips of double-sided tape 44. Plural tape strips 44 are used, one on each upper corner of the pad 26 and one adjacent each lower corner thereof.

It must be pointed out at this juncture that the releasable securement means 28 can be secured at other locations on the pad 26 from that shown in FIG. 2.

Each tape strip 44 includes a portion 46 permanently secured to the pad and a projecting or extending portion 48. An adhesive layer 50 is provided on each side of the extending portion 48 of the tape. Cover or liner strips 52 are provided over the adhesive portions 50 to protect the adhesive until the pad is to be attached to the garment.

As will be appreciated from the foregoing, the pad 26 can be secured to the inner surface 24 of the garment 22 with either of the vapor barrier 38 or the vapor barrier 36 being disposed immediately adjacent the inner surface 24.

In accordance with the preferred embodiment of this invention, one of the plastic vapor barriers of the pad 26 is metallized to be radiant-energy reflective while the other vapor barrier is darkly colored to be radiant-energy absorptive.

As will be appreciated by those skilled in the art, when the pad 26 is mounted within the garment 22 with the radiant-energy absorptive layer located immediately adjacent the inner surface of the garment any light or other radiant-energy which passes through the garment will be reflected by the layer back out of the garment, thereby keeping the wearer cool and dry in warm, humid environments. Conversely, with the pad 26 mounted within the garment 22 such that the radiant-energy absorptive layer is disposed immediately adjacent the inner surface 24, radiant-energy passing through the garment will be absorbed by the layer, thereby keeping the wearer dry, yet warm in cold weather conditions.

Figure 4:
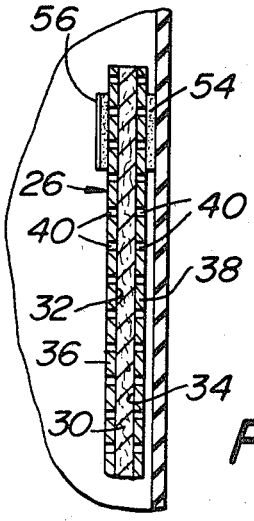
FIG. 4 is an enlarged sectional view, like that of FIG. 3, but of an alternative construction of the covering shown in FIG. 1.

In FIG. 4 there is shown an alternative construction for the releasable securement means 28 shown in FIG. 2. To that end, the releasable securement means of FIG. 4 utilizes a plurality of adhesive patches 54 permanently secured onto the barrier layers 36 and 38 in the pads' corners. Each of the patches 54 includes a cover or lining sheet 56 to protect the adhesive of the patch until securement of the pad within the garment is to be effected.

While the releasable securement means shown in FIGS. 2 and 3 comprise adhesive means, it is clear that the pad 26 can be secured to the inner surface 24 of garment 22 via any type of releasable securement means, e.g., snaps, buttons, etc. In fact, the garment 22 may be constructed to have its own adhesive strip for securing the pad 26 thereto. In such a construction, the pad 26 would not need its own releasable securement means. Moreover, the garment 22 can include a pocket therein for releasably securing the pad 26 on the inner surface of the garment.

It must also be pointed out at this juncture that the moisture barriers 36 and 38 need not be laminations or coatings having holes or pores therein, but can be woven or knitted fabrics formed of water-resistant materials.

As will be appreciated from the foregoing, the covering 20 of the instant invention is relatively simple and inexpensive in construction and provides a viable means for absorbing moisture commonly trapped within garments formed of impervious or non-porous materials thereby obviating an inherent disadvantage of such garments. Moreover, the fact that the covering 20 is inexpensive and is adapted for releasable securement, enable users to remove and replace a pad when desired, e.g., when a pad is full of absorbed moisture.

It must also be pointed out at this juncture that while the pad 26 shown in FIGS. 1 and 2 is of a generally trapezoidal shape so as to fit substantially the entire upper back area of the garment contiguous with the shoulders, it is clear that the pad can be of any shape, e.g., square, oval, etc. as desired. What is important is that the pad be located adjacent the shoulders since the moisture laden air trapped within the garment rises to said area.

In FIG. 5 there is shown a garment 200 constructed in accordance with a second aspect of this invention. The garment 200 can take any shape and as one example is shown as a reversible vest. The vest is arranged to be worn by itself, as shown in FIG. 5, or under a conventional garment, like vest 220, as shown in FIG. 6.

The vest 200 is arranged to provide thermal insulation for the wearer while absorbing moisture laden air between the garment and the wearer's body and while also permitting the relatively free transfer of air between the interior of the garment and the ambient atmosphere. As will be described in detail later, when the vest is worn on one side, it serves to keep the wearer warm, whereas when it is reversed, it serves to keep the wearer cool.

The vest 200 is fashioned out of a material like that forming the covering or pad 20 described heretofore, and as can be seen in FIG. 8, comprises a moisture absorbing central layer 222 having a pair of perforated moisture barriers 224 and 226 on the inner and outer surfaces 228 and 230, respectively, thereof. The central layer 222 is in the form of a moisture absorbing fabric which can be woven, non-woven or knitted and can be made from natural or synthetic fibers, such as polyethylene, specially treated for moisture absorbency. The moisture barriers 224 and 226 can be formed of any material impervious to water, providing such materials include a multitude of small holes or perforations 228 therein to expose the moisture absorbent fabric layer 222. One particularly suitable material for the barriers comprises the heretofore identified DELNET P520.

The moisture barrier 224 is metallized to reflect radiant-energy, while the barrier 226 is darkly colored to absorb radiant-energy. Accordingly, when the vest is worn with the radiant-energy reflective layer 224 facing outward, like shown in FIGS. 5 and 6, light and other radiant-energy is reflected off the vest, thereby keeping the wearer cool in warm environments. When the vest is reversed so that the dark colored layer is facing outward, light and other radiant-energy is absorbed to aid in keeping the wearer warm in cool environments.

No matter which side of the vest is worn outward, any moisture, such as perspiration, which would otherwise have a tendency to be trapped within the vest, is enabled to freely pass through the perforations in the inner layer 226 for absorption by the central fabric layer 222, with some moisture laden air escaping through the perforations in the outer layer 224. Thus, the perforations in both barriers not only provide means to allow the moisture laden air to be absorbed by the garment fabric but also ensure that the fabric breathes. Moreover, the moisture which is absorbed by the fabric's central layer 226 is kept off the skin of the wearer by the presence of the moisture barrier layers 224 and 226, thereby further aiding wearing comfort.

In FIG. 7 there is shown a reversible jacket 300 constructed in an identical manner to the vest 200 but including a pair of sleeves 302 for the wearer's arms. The sleeves 302 are formed of the same material as the remaining portion of the jacekt.

Without further elaboration, the foregoing will so fully illustrate my invention that others may, by applying current or future knowledge, readily adapt the same for use under various conditions of service.

What is claimed as the invention is:

1. For use in a garment adapted to be worn on the torso of a person and formed of a relatively impervious material and having an inner surface, the improvement comprising means for absorbing moisture in air trapped within said garment and releasable securement means for securing said moisture absorbing means within said garment and onto said surface, said moisture absorbing means comprising a pad having an inner and outer surface and formed of a moisture absorbent material, each of said surfaces including a moisture barrier thereon, each of said moisture barriers including plural openings therein exposing portions of said absorbent material to the air trapped within said garment, one of said moisture barriers having a radiant-energy reflective outer surface and the other of said moisture barriers having a radiant energy absorptive outer surface, said releasable securement means enabling either of said barriers to be disposed adjacent the inner surface of said garment when said moisture absorbing means is mounted within said garment.

2. In the garment of claim 1 wherein said releasable securement means comprises adhesive means.

3. In the garment of claim 2 wherein said adhesive means comprises adhesive tape.

4. In the garment of claim 3 wherein said adhesive tape comprises double-sided tape.

5. For use in a garment adapted to be worn on the torso of a person and formed of a relatively impervious material and having an inner surface, the improvement comprising means for absorbing moisture in air trapped within said garment, said moisture absorbing means being located within said garment and comprising a pad having an inner and outer surface and formed of a moisture absorbent material, each of said surfaces including a moisture barrier thereon, each of said moisture barriers including plural openings therein exposing portions of said absorbent material to the air trapped within said garment, one of said moisture barriers having a radiant energy reflective outer surface and the other of said barriers having a radiant energy absorptive outer surface, said moisture absorbing means being arranged so that either of said barriers is disposed adjacent the inner surface of said garment when said moisture absorbing means is located within said garment.

6. An outer covering to be worn on the body of a person, said covering comprising a fabric having an inner and outer surface and formed of a moisture absorbent material, each of said surfaces including a moisture barrier thereon, each of said moisture barriers including plural openings therein exposing portions of said absorbent material to the air trapped between said covering and the body of the person to enable said absorbent material to absorb said moisture while exposing portions of said absorbent material to the ambient air outside said covering to enable said fabric to breathe, one of said moisture barriers having a radiant energy reflective outer surface and the other of said barriers having a radiant energy absorptive outer surface.

7. The covering of claim 6 wherein said radiant-energy reflecting surface is metallized.

8. The covering of claim 6 wherein said radiant-energy absorbing layer is darkly colored.

9. The covering of claim 6 wherein said covering is in the form of a garment.

10. The covering of claim 6 wherein said radiant-energy reflective surface is metallized and wherein said radiant-energy absorbing surface is darkly colored.

11. The garment of claim 9 wherein said garment is reversible so that either of said barriers can be disposed outwardly.

* * * * *